US008929794B2

(12) United States Patent
Hatazaki

(10) Patent No.: US 8,929,794 B2
(45) Date of Patent: Jan. 6, 2015

(54) SHEET COOLING APPARATUS, SHEET CONVEYING APPARATUS AND SHEET MOISTURIZING APPARATUS

(71) Applicant: Canon Kabushiki Kaisha, Tokyo (JP)

(72) Inventor: Kazunari Hatazaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 13/652,794

(22) Filed: Oct. 16, 2012

(65) Prior Publication Data

US 2013/0121739 A1 May 16, 2013

(30) Foreign Application Priority Data

Oct. 17, 2011 (JP) ..... 2011-227899

(51) Int. Cl.
*G03G 15/20* (2006.01)

(52) U.S. Cl.
CPC ..... *G03G 15/2021* (2013.01)
USPC ..... 399/341; 399/323; 399/94; 399/97

(58) Field of Classification Search
USPC ..... 399/323, 341, 94, 97
See application file for complete search history.

(56) References Cited

U.S. PATENT DOCUMENTS 4,652,110 A * 3/1987 Sato et al. ..... 399/406
2009/0103959 A1 * 4/2009 Koyama et al. ..... 399/341

FOREIGN PATENT DOCUMENTS

JP 2008-112102 A 5/2008

* cited by examiner

*Primary Examiner* — Walter L Lindsay, Jr
*Assistant Examiner* — Roy Y Yi
(74) *Attorney, Agent, or Firm* — Fitzpatrick, Cella, Harper & Scinto

(57) ABSTRACT

A sheet cooling device includes a fixing device for heat fixing an unfixed image formed on a sheet; and a cooling device for cooling the sheet heated by the fixing device, the cooling device including, a rotatable endless belt contactable with the sheet heated by the fixing device and traveling above the fixing device; and a cooling member for cooling the endless belt to condense water vapor produced by a fixing operation.

28 Claims, 9 Drawing Sheets

SHEET COOLING APPARATUS, SHEET CONVEYING APPARATUS AND SHEET MOISTURIZING APPARATUS

FIELD OF THE INVENTION AND RELATED ART

The present invention relates to a sheet cooling apparatus, a sheet conveying apparatus, and a sheet moisturizing apparatus. These sheet cooling apparatus, sheet conveying apparatus, and sheet moisturizing apparatus are used for an image forming apparatus which uses an electrophotographic image formation process.

In the field of an image forming apparatus which uses an electrophotographic image forming method, it is common practice to form a latent image on a photosensitive drum (image bearing member), and develop the latent image into a visible image, with the use of toner. Then, the visible image is electrostatically transferred onto a sheet of recording medium (which may be referred to simply as sheet, hereafter). Then, the toner image (unfixed toner image) on the sheet is fixed to the sheet by being subjected to heat and pressure by the fixing device of the apparatus, ending the image formation sequence.

During this image formation sequence, a sheet of recording medium is subjected to heat while it is conveyed through the fixing device. Thus, a certain amount of moisture evaporates from the sheet. Therefore, the amount of moisture in the sheet before the fixation of the toner image is different from that after the fixation, making it possible that the stress to which the sheet is subjected after the fixation will make the sheet wavy and/or curly. More concretely, as the sheet is observed at the level of the fiber of which it is made, the sheet is made up of tangled short strands of fiber. Further, each strand of fiber contains moisture, and also, moisture is present between adjacent two strands of fiber. Moreover, hydrogen bonds occur between fiber and water. More concretely, cellulose has a large number of hydroxyl radicals, which tend to attract other hydrogen atoms because of their polarity. Thus, the presence of water molecules between adjacent strands of fiber is likely to cause hydrogen bonding to occur.

Therefore, as heat is applied to a sheet of recording medium during the fixation of an unfixed toner image to the sheet, the moisture in the sheet evaporates. Consequently, the hydroxyl radical of the cellulose of the fiber bonded to water (moisture), through hydrogen bonding, bonds with the hydroxyl radical of the other cellulose, causing the sheet to deform by an amount proportional to the amount of the moisture lost from the sheet by the evaporation. That is, the hydrogen bonding which occurs among the strands of fiber causes the sheet to deform. Then, as the sheet is left unattended for a substantial length of time, it absorbs moisture from its ambience, causing its fiber strands to lose their hydrogen bonding. However, it does not occur that water molecules enter all the gaps among the strands of fiber. Therefore, the deformation of the sheet does not entirely disappear. For this reason, it is possible that the image front and rear surfaces of the sheet will become different in the amount of expansion and/or shrinkage, causing the sheet to become curly.

Further, it is possible that the center portion of the sheet becomes different in the amount of expansion and/or shrinkage from the peripheral portions of the sheet, causing the sheet to become wavy. These phenomenons occur for the following reason. That is, if the sheet is left unattended for a substantial length of time, in an environment which is greater in moisture content than the sheet, the sheet absorbs the moisture in the environment, and expands by the amount proportional to the amount by which the moisture was absorbed by the sheet. Further, the peripheral portion of the sheet absorbs more moisture than the center portion of the sheet. In other words, the center portion of the sheet, which absorbs the moisture in the ambience less than the peripheral portions of the sheet, is therefore smaller in the amount of volumetric expansion. Thus, the center portion of the sheet becomes different in the amount of expansion (or shrinkage) from the peripheral portions of the sheet. Consequently, the sheet becomes wavy. Base on this theory, it is reasonable to think that the smaller the amount of moisture in the sheet after the fixation, compared to the amount of moisture in the sheet after the moisture content of the sheet became equivalent to the humidity of the environment in which the sheet is left unattended after the fixation, the more wavy the sheet is likely to become.

In order to deal with the above described issue, the fixing apparatus disclosed in Japanese Laid-open Patent Application 2008-112102 is provided with a system which has a pair of endless belts, and cools a sheet of recording medium by conveying the sheet between the endless belts while keeping the sheet pinched between the endless belts.

However, the apparatus disclosed in Japanese Laid-open Patent 2008-112102 is structured to simply prevent the moisture in a sheet of recording medium from evaporating after the cooling of the sheet. In other words, it does not address the problem that the amount of moisture in a sheet of recording medium after the fixation is substantially different from that prior to the fixation. Therefore, a cooling system like the one disclosed in Japanese Laid-open Patent Application 2008-112102 cannot satisfactorily prevent the aforementioned problem that the sheet becomes wavy and/or curly after the fixation.

SUMMARY OF THE INVENTION

Thus, the primary object of the present invention is to provide a sheet cooling apparatus which satisfactorily prevents the problem that a sheet of recording medium becomes wavy and/or curly after the fixation.

Another object of the present invention is to provide a sheet conveying apparatus which satisfactorily prevents the problem that a sheet of recording medium becomes wavy and/or curly after the fixation.

According to an aspect of the present invention, there is provided a sheet cooling device comprising a fixing device for heat fixing an unfixed image formed on a sheet; and a cooling device for cooling the sheet heated by said fixing device, said cooling device including, a rotatable endless belt contactable with the sheet heated by said fixing device and traveling above said fixing device; and a cooling member for cooling said endless belt to condense water vapor produced by the fixing process operation.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

(1) Typical Image Forming Apparatus

Figure 1:
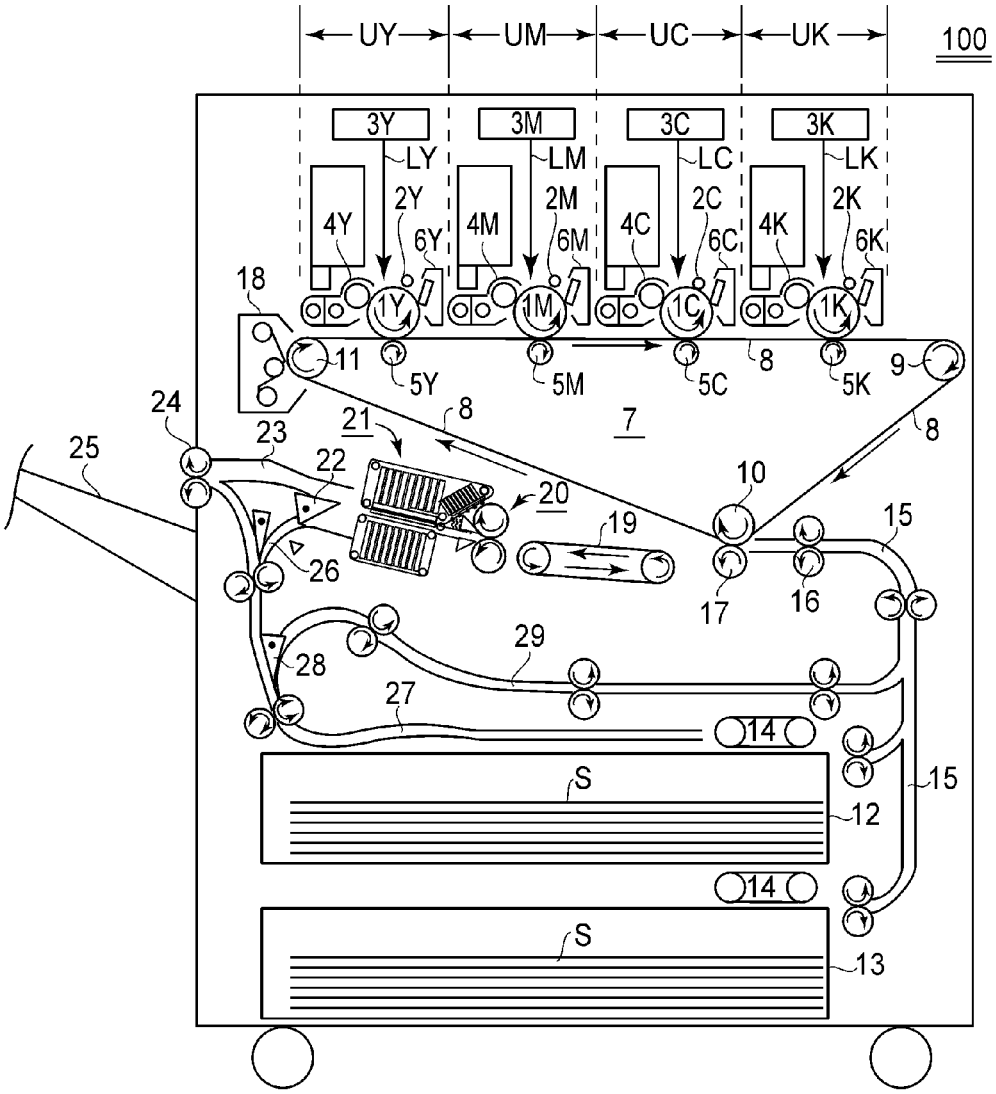
FIG. 1 is a schematic sectional view of the image forming apparatus in the first embodiment of the present invention. It is for describing the general structure of the apparatus.

FIG. 1 is a schematic sectional view of the image forming apparatus in the first embodiment of the present invention. It is for describing the general structure of the apparatus. This apparatus 100 is an electrophotographic full-color (natural color, multi-color) laser beam printer of the tandem-intermediary transfer type. It can form a full-color image on a sheet S of recording medium, based on the four primary colors, in response to the image formation signals inputted into the control circuit (unshown) of the apparatus 100 from a host apparatus such as a personal computer, or the like. The sheet S is a recording medium on which a visible image is formed of developer.

It is a sheet of ordinary paper, a sheet of glossy paper, an envelop, a postcard, a label, a sheet of OHP film, or the like, for example.

The apparatus 100 contains the first to fourth image formation stations U (UY, UM, UC and UK), listing from the left side, which are horizontally aligned in tandem. The four image formation stations sequentially form four images (image formed of developer) which are different in color. Each of the four image formation stations U is an electrophotographic image formation system on its own. The four image formation stations U are the same in structure, although they are different in the color, for example, yellow (Y), magenta (M), cyan (C) and black (K), of developer (which will be referred to as toner, hereafter).

The image formation stations UY, UM, UC and UK are mostly the same in structure and operation. In the following description of the embodiments of the present invention, therefore, the four image formation stations are described together by eliminating the suffixes Y, M, C and K of the referential codes, which indicate the color of the images they form.

Each image formation station U has a rotatable photosensitive drum 1 (image bearing member), on the peripheral surface of which an electrostatic latent image is formed. The drum 1 is rotated in the counterclockwise direction indicated by an arrow mark in FIG. 1, at a preset peripheral velocity. Each image formation station U has also a primary charging device (roller) 2, an exposing device (laser scanner) 3, a developing device 4, a primary transfer device (roller) 5, and a cleaning device 6, which are arranged in the listed order, in the adjacencies of the peripheral surface of the drum 1.

To the primary charging device 2, a preset charge bias is applied, whereby the surface of the peripheral surface of the rotating drum 1 is uniformly charged to preset polarity and potential level. The exposing device 3 scans (exposes) the uniformly charged portion of the peripheral surface of the drum 1 by outputting a beam L of laser light while modulating the beam L according to the information inputted into the control circuit, regarding the image to be formed, from the host apparatus. Thus, an electrostatic latent image, which reflects the information of the image to be formed, is formed on the peripheral surface of the drum 1. Then, the electrostatic latent image is developed into a visible image, that is, an image formed of toner, which will be referred to as tone image, hereafter.

Through the image formation sequence consisting of such processes as the charging, exposing, and developing processes described above, yellow (Y), magenta (M), cyan (C), and black (K) toner images, which correspond to the yellow (Y), magenta (M), cyan (C) and black (B) color components, respectively, of a full-color image are formed on the drums 1Y, 1M, 1C and 1K of the first, second, third, and fourth image formation stations UY, YM, YC and YK, respectively.

The apparatus 100 is provided with an intermediary transfer belt unit 7, which extends under the first, second, third, and fourth image formation stations U. The intermediary transfer belt unit 7 has an intermediary transfer belt 8 (intermediary transfer member), which is flexible and endless. It is circularly moved. As it is circularly moved, it sequentially receives toner images from the image formation stations U, one for one. The belt 8 is suspended and kept stretched by three rollers, more specifically, a driver roller 9, a belt backing roller (which opposes secondary transfer roller with presence of intermediary transfer belt 8 between itself and secondary transfer roller), and a tension roller 11. The belt 8 is circularly moved by the roller 9 in the clockwise direction indicated by an arrow mark, at roughly the same speed as the peripheral velocity of the drum 1.

The primary transfer device 5 (roller) of each image formation station U is kept pressed against the downwardly facing portion of the peripheral surface of the drum 1, with the presence of the belt 8 between itself and photosensitive drum 1. The area of contact between the drum 1 and belt 8 is the primary transfer nip. As a preset primary transfer bias is applied to the roller 5, the toner image on the drum 1 is transferred (primary transfer) onto the outward surface of the belt 8 in the primary transfer nip. The toner remaining on the peripheral surface of the drum 1 after the primary transfer of the toner image is removed from the peripheral surface of the drum 1 by the cleaning device 6. The four toner images, different in color, are formed in the four image formation stations U, one for one, with such a timing that the toner images are sequentially transferred in layers (primary transfer) in such a manner that the four toner images are layered on the belt 8.

Thus, as the portion of the belt 8, onto which a yellow (Y) toner image was transferred in the first image formation station UY, comes out of the primary transfer station of the fourth image formation station UK, an unfixed full-color image, that is, layered four toner images, different in color, is present on the belt 8, that is, an unfixed full-color image is synthetically formed on the belt 8. The roller 10 is kept pressed against a secondary transfer device (roller) 17, with the presence of the belt 8 between itself and secondary transfer roller 17. The area of contact between the transfer roller 17 and belt 8 is the secondary transfer nip. After the formation of an unfixed full-color toner image on the belt 8, the toner image is conveyed to the secondary transfer nip by the subsequent circular movement of the belt 8.

Meanwhile, one of the first and second sheet feeder cassettes 12 and 13 of the sheet feeder unit 14 begins to be driven with preset control timing. As the cassette 12 or 13 is driven, the multiple sheets S of recording medium stored in layers in the cassette 12 or 13 are fed one by one into the main assembly of the apparatus 100. Then, each sheet S is conveyed to a pair of registration rollers 16 through the first sheet passage 15. Then, the sheet S is released by the registration rollers 16 so that the sheet S is introduced into the secondary transfer nip with preset control timing. Then, the sheet S is conveyed through the secondary transfer nip while remaining pinched by the secondary transfer roller 17 and belt 8. Further, while the sheet S is conveyed through the secondary transfer nip, a preset secondary transfer bias is applied to the roller 17, whereby the toner images layered on the belt 8 are transferred together (secondary transfer) onto the sheet S.

In the case of the image forming apparatus 100 in this embodiment, a sheet S of recording medium is conveyed so that its centerline in terms of the direction perpendicular to the recording medium conveyance direction a coincides with the centerline of the recording medium passage of the apparatus 100, regardless of sheet size. The width of a sheet S of recording medium means the measurement of the sheet S in terms of the direction perpendicular to the recording medium conveyance direction.

After being conveyed through the secondary transfer nip, the sheet S is separated from the belt 8, and is introduced by a sheet conveying device 19 of the belt type, into a fixing device 20 (image heating device: image heating portion that permanently fixes unfixed toner image on sheet, by heating combination of sheet and unfixed toner image thereon). The toner remaining on the belt 8 after the secondary transfer is removed from the belt surface by the cleaning apparatus 18 located adjacent to where the belt 8 is in contact with the roller 11. The sheet S and the unfixed toner image thereon are subjected to heat and pressure by the fixing device 20, whereby the unfixed toner image is thermally and permanently fixed to the surface of the sheet S.

After being conveyed out of the fixing device 20, the sheet S is introduced into a cooling apparatus 21 which is positioned next to the fixing device 20, and in which the sheet S is moisturized while being cooled. The fixing device 20 and cooling device 21 are going to be described in more detail in Sections (2) and (3).

If the image forming apparatus 100 is in the one-sided mode, the flapper 22 is positioned so that after the sheet S comes out of the cooling device 21, the sheet S is guided by the flapper 22 into the second sheet passage 23, and then, is discharged by a pair of discharge rollers 24 into the external delivery tray 25 of the apparatus 100.

If the apparatus 100 is in the two-sided mode, the flapper 22 is positioned so that after the sheet S comes out of the cooling device 21, the sheet S (having fixed image on one of its surfaces) is introduced by the flapper 22 into the sheet passage 26. Then, the sheet S is made to enter the switchback sheet passage 27. Next, it is conveyed backward from within the switchback sheet passage 27, and is guided into a sheet conveyance passage 29 (two-sided mode passage) by a flapper 28, which has just been switched in position after the sheet S was moved past the flapper 28. Then, the sheet S is returned from the sheet passage 29 into the first sheet passage 15, and is reintroduced into the second transfer nip by the pair of registration rollers 16, with a preset timing, in such an attitude that the opposite surface of the sheet S from the surface onto which a toner image has been already transferred, faces downward.

Thus, the toner images on the belt 8 are transferred together (second transfer) onto the second surface of the sheet S, in the second transfer nip. After toner images were transferred together (secondary transfer) onto the second surface of the sheet S, the sheet S is separated from the belt 8, and is reintroduced into the fixing device 20, in which the unfixed toner images on the second surface of the sheet S are permanently fixed to the second surface of the sheet S. Next, the sheet S is reintroduced into the cooling device 21, in which the sheet S is cooled. Then, the sheet S is discharged as a two-sided print, into the delivery tray 25 through the second sheet passage 23.

When the apparatus 100 is in the monochromatic mode of a specific color, for example, the black-and-white mode, only the image formation station which corresponds in color to the specific color, is operated, while the image formation stations which do not correspond in color to the specific color are not operated for image formation, although they still are rotated.

(2) Sheet Cooling Device (Sheet Conveying Device, Sheet Moisturizing Device)

Figure 2:
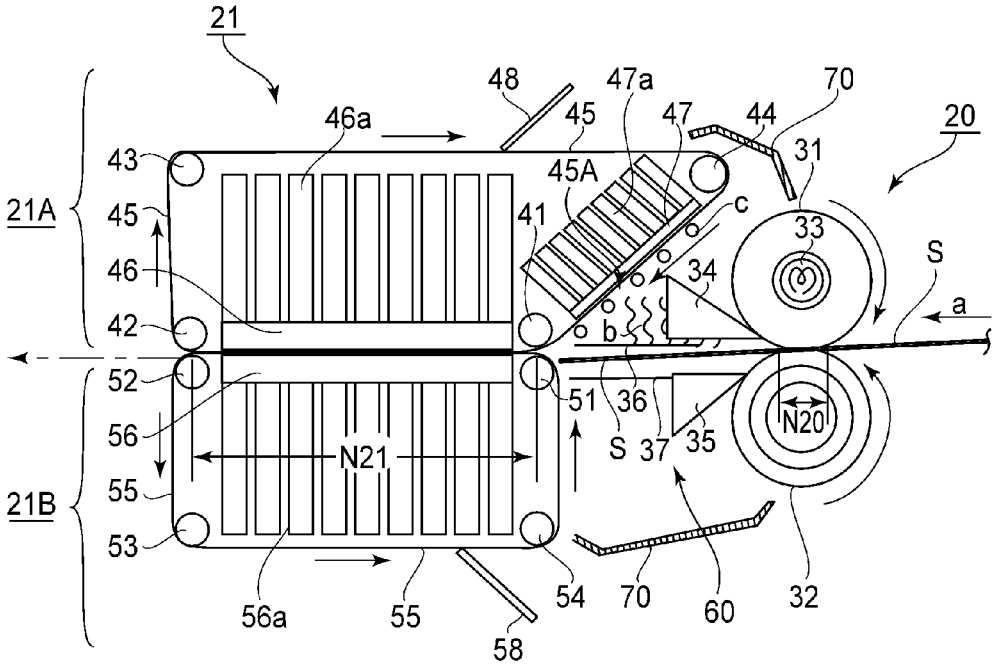
FIG. 2 is a schematic sectional view of the combination of the fixing device and cooling device (cooling apparatus) of the image forming apparatus shown in FIG. 1.

FIG. 2 is a schematic drawing of the combination of the sheet cooling device (sheet conveying device) 21 and fixing device (thermal fixing device) 20. The fixing device 20 in this embodiment is of the so-called thermal roller type. It has a fixation roller 31 and a pressure roller 32, which are vertically stacked in parallel to each other, and which are kept pressed upon each other.

The fixation roller 31 is a heat roller, with which the surface (image formation surface) of the sheet S of recording medium having an unfixed toner image comes into contact. It is hollow, and is heated from within by an internal heat source 33 such as a halogen heater positioned in its hollow, while being controlled by a temperature control system (unshown) in such a manner that its surface temperature remains at a preset level suitable for image fixation. The pressure roller 32 is an elastic roller having a heat resistant rubber layer. Thus, as the pressure roller 32 is pressed against the heater roller 31, the fixation nip N20, which has a preset width in terms of the recording medium conveyance direction a, is formed.

The fixation roller 31 is rotated by a fixation motor (unshown) in the clockwise direction indicated by an arrow mark at a preset speed which is equal to the process speed (sheet conveyance speed). The pressure roller 32 is rotated in the counterclockwise direction indicated by an arrow mark in the drawing, by the rotation of the fixation roller 31, which is transferred to the pressure roller 32 by the friction which occurs between the fixation roller 31 and pressure roller 32 in the fixation nip N20. The fixation roller 31 is internally heated by the heat source 33 while being rotated. While the temperature of the peripheral surface of the fixation roller 31 is kept at the preset fixation level, the sheet S, which is bearing the unfixed toner image on its top surface is introduced into the fixation nip N20 from the direction of the image formation system, and is conveyed through the fixation nip N20 while remaining pinched by the pressure roller 32 and fixation roller 31.

Therefore, the sheet S and the unfixed toner image thereon are heated and pressed in the fixation nip N20. Thus, the unfixed toner image becomes fixed to the image formation surface of the sheet S, yielding a finished print. The fixing device 20 is provided with a pair of sheet separating members 34 and 35, which are on the exit side of the fixation nip N20. The sheet separating member 34 is on the top side of the sheet conveyance passage, with its sheet separating edge being in the adjacencies of the peripheral surface of the fixation roller 31, or in contact with the peripheral surface of the fixation roller 31, whereas the sheet separating member 35 is on the underside of the sheet conveyance passage, with its sheet separating edge being in the adjacencies of, or in contact with, the peripheral surface of the pressure roller 32. After being conveyed out of the fixation nip N20, the sheet S is separated from the fixation roller 31 and/or pressure roller 32 by the sheet separating members 34 and 35, respectively. Then, the sheet S is introduced in to the nip N21 of the cooling device 21 (which will be described next) through the gap between sheet guiding top and bottom plates 36 and 37.

The fixing device 20 may be structured so that the pressure roller 32 also is heated by a heat source to keep the temperature of the peripheral surface of the pressure roller 32 at a preset level. Further, the fixing device 20 may be structured so that the pressure roller 32 also is driven by its own mechanical power source.

(3) Cooling Device 21

The cooling device 21 is in the proximity of the downstream side of the fixing device 20 in terms of the sheet conveyance direction a (recording medium conveyance direction), with the presence of the aforementioned sheet separating members 34 and 35, and the sheet conveyance guide plates 36 and 37, between the cooling device 21 and fixing device 20. The fixing device 20 applies heat to a sheet of recording medium and the unfixed toner image thereon. Thus, the moisture in the sheet evaporates while and after the sheet is conveyed through the fixation nip N20. The cooling device 21 is for cooling the sheet S, and also, for moisturizing the sheet S, immediately after the sheet S comes out of the fixing device 20. The cooling device 21 is effective to minimize the problem that the sheet S becomes curly and/or wavy after its discharge from the image forming apparatus 100.

The cooling device 21 in this embodiment has the first belt unit 21A (top belt unit) and the second belt unit 21B (bottom belt unit), which form the nip N21 through which the sheet S is conveyed. While the sheet S is conveyed through the nip N21, it is moisturized and cooled.

The first belt unit 21A has a pair of horizontal rollers, that is, the first and second rollers 41 and 42, or the upstream and downstream rollers in terms of the sheet conveyance direction a, with the presence of a preset distance between the two rollers 41 and 42. The rotational axis of the roller 41 and the rotational axis of the roller 42 are parallel to the rotational axis of the fixation roller 31. The first belt unit 21A has also another roller, that is, the third roller 43, which is above the second roller 42. The third roller 43 is parallel to the second roller 42. Further, there is a preset distance between the second and third rollers 42 and 43. The first belt unit 21A has also another roller, or the fourth roller 44, which is at roughly the same level as the third roller 43. The fourth roller 44 is above the sheet separating top member 34, which is on the upstream side of the first roller 41, and is parallel to the third roller 43.

Further, the first belt unit 21A has a flexible endless belt 45, which is suspended and kept tensioned by the aforementioned four rollers, that is, the first to fourth rollers 41-44 as belt suspending members. There are the first flat cooling plate (first cooling means) 46 and second flat cooling plate (second cooling means) 47 within the loop which the endless belt 45 forms. The first flat cooling plate 46 (which remains in contact with endless belt 45) has multiple air-cooled heat sinks 46*a*, which are attached to the opposite side of the flat cooling plate 46 from the endless belt 45. The second flat cooling plate 47 (which remains in contact with endless belt 45) has multiple air-cooled heat sinks 47*a*, which are attached to the opposite side of the flat cooling plate 47 from the endless belt 45. In consideration of heat radiation efficiency and ease of formation, aluminum is used as the material for the flat cooling plates 46 and 47, and their heat sinks 46*a* and 47*a*, respectively.

The first flat cooling plate 46 is in contact with roughly the entirety of the portion of the inward surface of the endless belt 45, which is between the first and second rollers 41 and 42. As for the second flat cooling plate 47, it is in contact with roughly the entirety of the portion of the inward surface of the endless belt 45, which is between the fourth and first rollers 44 and 41. Further, the first belt unit 21A is provided with a belt wiping blade (water bead removing flat plate) 48, as means for removing beads of water resulting from the condensation of the water vapor from a sheet of recording medium. The belt wiping blade 48 is kept pressed, by its wiping edge, upon the portion of the outward surface of the endless belt 45, and between the third and fourth rollers 43 and 44.

The second roller 42 of the abovementioned first belt unit 21A is a driver roller. The third roller 43 of the first belt unit 21A is the tension roller which keeps the belt 45 tensioned.

The second belt unit 21B has a pair of horizontal rollers, that is, the first and second rollers 51 and 52, which are the upstream and downstream rollers in terms of the sheet conveyance direction a. The two rollers 51 and 52 are positioned with the presence of a preset amount of distance between the two. The rotational axis of the roller 51 and the rotational axis of the roller 52 are parallel to the rotational axis of the fixation roller 31. The second belt unit 21B has also the third roller 53, which is below the second roller 52, with the presence of a preset mount of distance from the second roller 52. The third roller 53 is parallel to the second roller 52. Further, the second belt unit 21B has another roller, or the fourth roller 54, which is below the first roller 51, being positioned in parallel to the first roller 51, with the presence of a preset distance from the first roller 51.

Further, the second belt unit 21B has a flexible endless belt 55, which is suspended and kept tensioned by the first to fourth rollers 51-54, which function as belt suspending members. The third roller 53 functions as the tension roller for keeping the belt 55 tensioned. The second belt unit 21B has also a flat cooling plate 56 (first cooling means), which is the third flat cooling plate of the cooling device 21. The flat cooling plate 56 is within the loop which the belt 55 forms. This flat cooling plate 55 also is provided with multiple heat sinks 56*a*, which are on the opposite side of the plate 56 from the belt 55.

The third flat cooling plate 56 is in contact with roughly the entirety of the portion of the inward surface of the belt 55, which is between the first and second rollers 51 and 52. Further, the second belt unit 21B is provided with a belt wiping blade 58 (as means for removing condensed water vapor), which is kept pressed upon the outward surface of the portion of the belt 55, which is between the third and fourth rollers 53 and 54.

The first and second belt units 21A and 21B are positioned so that the first rollers 41 and 51 of the first and second belt units 21A and 21B, respectively, are kept vertically pressed against each other by the application of a preset amount of force, with the presence of the belts 45 and 55 between the two rollers 41 and 51. Further, the first and third flat cooling plates 46 and 56 are kept vertically pressed against each other, with the presence of the belts 45 and 56 between the two cooling plates 46 and 55, by the application of a preset amount of force.

Thus, the portion of the belt 45 of the first belt unit 21A, which is between the first and second roller 41 and 42 is kept flatly in contact with the portion of the belt 56 of the second belt unit 21B, which is between the first and second rollers 51 and 52 of the second belt unit 21B, by the aforementioned preset amounts of force. Therefore, there is a nip N21, which is flat, and wide in terms of the sheet conveyance direction a (recording medium conveyance direction).

As the second roller 42, which is the roller for driving the belt 45 of the first belt unit 21A, is driven by one of the motors (unshown) of the image forming apparatus 100, the belt 45 is circularly driven by the second roller 42 in the clockwise direction indicated by an arrow mark at a preset process speed (sheet conveyance speed). As for the belt 55 of the second belt unit 21B, it is circularly rotated in the counterclockwise direction indicated by another arrow mark by the rotation of the belt 45 (friction between two belts 45 and 55).

The fan 200 (FIG. 3) as an air blowing device creates airflow which flows through the inward side of each of the loops which the two endless belts 45 and 55 form one for one. Thus, the heat sinks 46*a*, 47*a*, and 56*a* of the first to third flat cooling plates 46, 47, and 56, respectively, are air-cooled.

The belts 45 and 55 are moved through the nip N21 in such a manner that the inward surface of the belt 45 and the inward surface of the belt 55 slide on the first and third flat cooling plates 46 and 56, respectively. Thus, the belt 45 and 55 are cooled in the nip N21. Further, the belt 45 of the first belt unit 21A is cooled by the second flat cooling plate 47, between the fourth and first rollers 44 and 41.

In this embodiment, the belts 45 and 55 are 560 mm in width, and are formed of polyimide resin. Here, the width of the belts 45 and 55 means the measurement of the belts 45 and 55 in terms of the direction perpendicular to the sheet conveyance direction a. The width (measurement) of the nip N21 in terms of the sheet conveyance direction a is roughly 400 mm. The length and width of the first and third flat cooling plates 46 and 56 are roughly 400 mm and 400 mm, respectively.

Designated by a referential code 60 is a sheet separation space between the sheet exit of the fixation nip N20 (recording medium exit) of the fixing device 20, and the sheet entrance (recording medium entrance) of the cooling device 21. As the sheet S of recording comes out of the fixation nip N20 of the fixing device 20, it goes through the space between the top and bottom sheet separating members 34 and 35, which are in the space 60. Then, it goes through the space between the top and bottom sheet guiding plates 36 and 37, which also are in the space 60. Then, it enters the nip N21 of the cooling device 21, and is conveyed through the nip N21 while remaining pinched between the belts 45 and 55.

In the nip N21, the belt 45 of the first belt unit 21A contacts the surface of the sheet S of recording medium, on which a toner image is present, and the belt 55 of the second belt unit 21B contacts the surface (back surface) of the sheet S, which is opposite from the surface having the toner image. While the sheet S is conveyed through the nip N21 while remaining pinched between the two belts 45 and 55, it is cooled by the belts 45 and 55 which are being cooled by the flat cooling plates 46 and 56, respectively, while remaining virtually air-tightly sealed by the two belts 45 and 55. In order to ensure that the belts 45 and 55 begin to be cooled as soon as the sheet S is introduced into the nip N21, the cooling device 21 is structured so that the position at which the belts 45 and 55 begin to contact each other roughly coincides with the point at which the two belts 45 and 55 begins to be cooled by the flat cooling plates 46 and 56, respectively, in terms of the sheet conveyance direction a.

As the sheet S of recording medium is flatly conveyed in the nip N21 while remaining virtually air-tightly sealed in the nip N21, moisture is given to the surface of the sheet S, on which the toner image is present, from the belt 45 of the belt unit 21A. The details of this giving of moisture from the belt 45 to the sheet S are as follows:

In the case of the cooling device 21 in this embodiment, the fourth roller 44, that is, one of the rollers by which the belt 45 is suspended, is on the upstream side of the first roller 41, and above the top sheet separating member 34. With this placement of the fourth roller 44, the loop which the belt 45 of the first belt unit 21A forms is so shaped, in terms of its vertical cross-section parallel to the sheet conveyance direction a, that the portion of the belt loop between the third and fourth rollers 43 and 44 extends backward, in terms of the sheet conveyance direction a, beyond the first roller 41, and the portion of the belt loop between the fourth and first rollers 44 and 41 diagonally extends from the fourth roller 44 to the first roller 41; the portion of the belt loop diagonally extends between the sheet entrance of the nip N21 of the cooling device 21 and the top portion of the fixing device 20.

That is, the portion of the belt loop, which is between the first and fourth rollers 41 and 44, diagonally extends above the top sheet separating member 34 and the top sheet conveyance guide 36, which are between the sheet exit of the fixation nip N20 of the fixing device 20 and the sheet entrance of the nip N21 of the cooling device 21.

Hereafter, the portion of the belt loop, which is between the fourth and first rollers 44 and 41 is referred to as a diagonal (slanted) portion 45A of the belt loop. That is, the loop formed by the belt 45, which forms the nip N21, has the diagonal portion 45A, which diagonally extends in the sheet separation space 60, which is between the sheet exit of the fixation nip N20 of the fixing device 20 and the sheet entrance of the nip N21 of the cooling device 21.

The fixing device 20 applies heat to the sheet S of recording medium and the toner image thereon while it is conveying the sheet S through its fixation nip N20 while keeping the sheet S pinched between its fixation roller 31 and pressure roller 32. Therefore, the moisture in the sheet S evaporates while and after the sheet S is conveyed through the fixation nip N20. The water vapor (steam) which evaporated from the top surface of the sheet S rises through the multiple air vents of the top sheet conveyance guide 36 and also, through the adjacencies of the top sheet separating member 34, in the sheet separation space 60, through which the sheet S moves between when the sheet S comes out of the fixation nip N20 of the fixing device 20 and when it enters the nip N21 of the cooling device 21.

Then, the water vapor lingers in the space surrounded by the top sheet conveyance guide 36, fixation roller 31, and the aforementioned diagonal portion 45A of the loop which the belt 45 forms. Eventually, the water vapor comes into contact with the portion of the belt 45, which is moving through the diagonal portion 45A of the belt loop, and which has been cooled by the second flat cooling plate 47. Thus, it is condensed into numerous water beads, which adhere to the outward surface of the portion of the belt 45, which is moving through the diagonal portion 45A of the belt loop. The small circles designated by referential codes b and c in FIG. 2 schematically represent the rising water vapor and the water beads having resulted from the water vapor and adhered to the outward surface of the portion of the belt 45, which corresponds to the portion 45A of the belt loop. Designated by a referential code 70 is a housing (cover) positioned to cover the side of the sheet separation space 60 to minimize the amount by which the water vapor escapes from the space 60.

The water beads c having resulted from the condensation of the water vapor from the sheet S of recording medium and adhered to the outward surface of the portion of the belt 45, which is moving through the diagonal portion 45A of the belt loop, is conveyed to the nip N21 of the cooling device 21, and then, is conveyed through the nip N21, by the subsequent movement of the belt 45. Thus, while the sheet S is conveyed through the nip N21 of the cooling device 21, the water beads on the belt 45 adhere to the surface (top surface) of the sheet S, on which the toner image is present. That is, as the moisture in the sheet S evaporates from the sheet S, it is captured in the form of water beads c by the belt 45. Then, the water beads c are returned to the sheet S; the sheet S is moisturized.

Therefore, it is possible to efficiently return the moisture from the sheet S of recording medium, back into the sheet S to prevent the sheet S from becoming wavy and/or curly. Moreover, the sheet S is kept virtually sealed in the nip N21 while it is cooled. In other words, the sheet S is restored in terms of its moisture content while the sheet S is high in temperature and humidity, being therefore low in Young's modulus. Therefore, it is possible to minimize the extent to which the sheet S becomes curly and/or wavy. Further, the sheet S is cooled in a virtually air-tightly sealed space. Therefore, by the time the sheet S is released from the sealed space, the sheet S will be in the state in which the moisture in the sheet S does not evaporates. Therefore, such a problem that the moisture from the sheet S condenses on the unintended places in the cooling device 21 (and also, apparatus 100), does occur. Therefore, the cooling device 21 remains stable in recording medium conveyance performance, and also, the sheet S is properly conveyed and accumulated.

From the standpoint of efficiently preventing a sheet S of recording medium from becoming curly and/or wavy, the cooling device 21, which is for cooling the sheet S after the sheet S comes out of the fixing device 20, should be placed immediately downstream of the fixing device 20. However, there are the sheet separating members 34 and 35, and sheet conveyance guides 36 and 37, in the immediate adjacency of the downstream side of the fixing device 20. Therefore, there is a limit in placing the cooling device 21 as close as possible to the fixing device 20.

In this embodiment, therefore, the cooling device 21 is structured so that the portion 45A of the loop which the belt 45 forms, and through which the belt 45 is cooled by the flat cooling plate 47, is positioned above the portion of the sheet conveyance passage, which is between the exit of the fixing device 20 and the entrance of the cooling device 21, and also, above and away from the sheet separating members 34 and 35, and the sheet conveyance guides 36 and 37. That is, the cooling device 21 is structured so that the portion 45A of the belt loop diagonally extends between the entrance of the nip N21 and roughly the top portion of the fixation roller 31, in the sheet separation space 60. Therefore, the water vapor having risen from the sheet S of recording medium is captured by the portion of the belt 45, which is moving through the diagonal portion 45A of the belt loop, and condenses into water beads, on the belt 45, and then, is returned to the sheet S. With the employment of the above described structural arrangement for the combination of the cooling device 21 and fixing device 20, the presence of the sheet separating members 34 and 35 and sheet guiding plates 36 and 37 on the immediately downstream side of the fixing device 20 does not matter.

Figure 3:
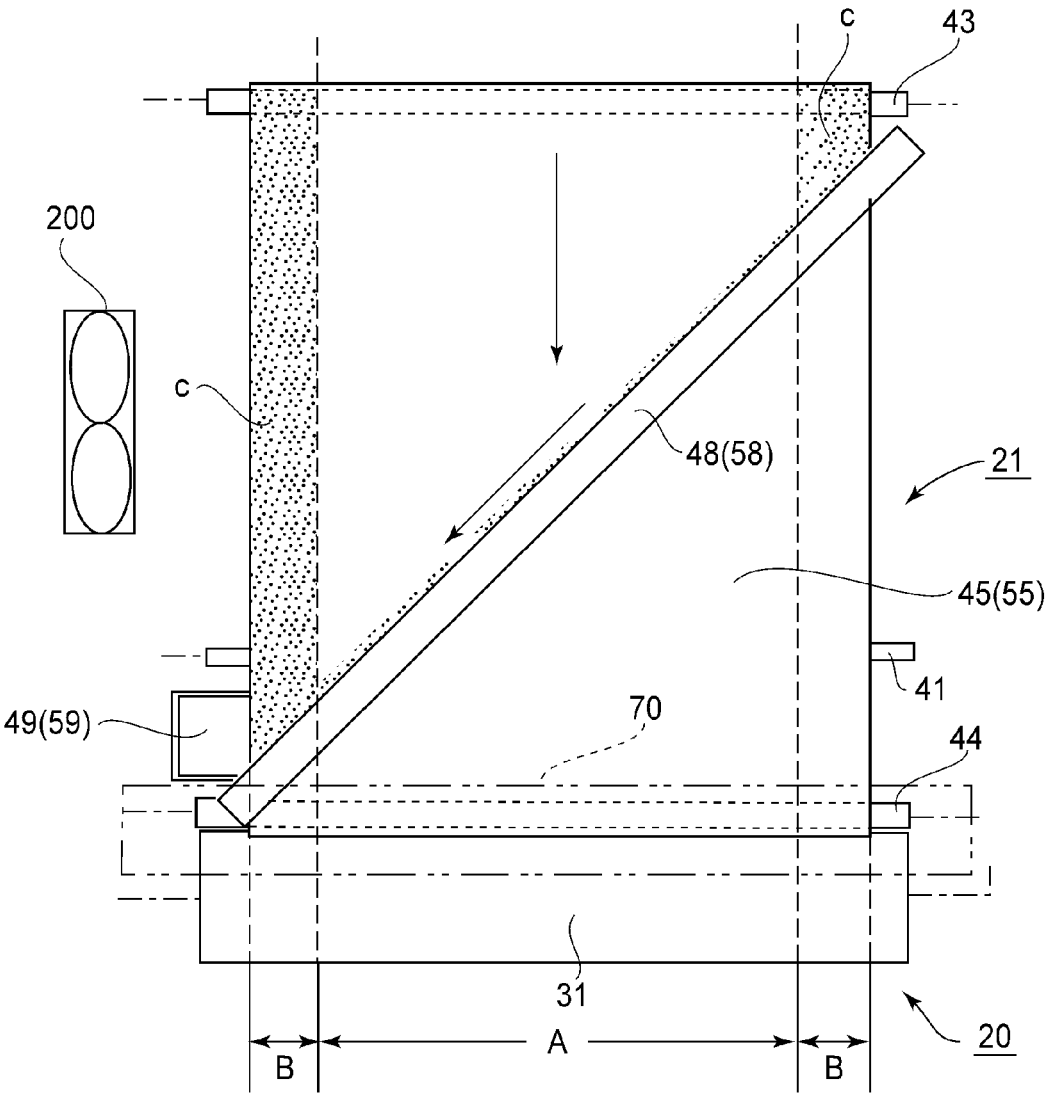
FIG. 3 is a top plan view of the combination of the fixing device and cooling device (cooling apparatus) shown in FIG. 2.

Referring again to FIG. 2, referential codes 48 and 58 stand for belt wiping members which play the role of removing the water beads resulting from the condensation of the water vapor from the sheet S of recording medium, upon the belt 45 and 55, from the belts 45 and 55 of the first and second belt units 21A and 21B, respectively. FIG. 3 is a schematic plan view (top plan view) of the combination of the fixing device 20 and cooling device 21. The drawing shows only the belt wiping member 48 of the first belt unit 21A. In terms of the moving direction (direction of circular movement of belt 45) of the belt 45, the belt wiping blade 48 is on the upstream side of the second flat cooling plate 47.

More specifically, the belt wiping blade 48 is kept pressed upon the belt 45 by its wiping edge, between the third and fourth roller 43 and 44. It is tilted by 45 degrees relative to the moving direction of the belt 45 (direction of circular movement of belt 45). It is kept upon the belt 45 across the entire width of the belt 45. Designated by a character A is the portion of the outward surface of the belt 45, which coincides with the path (track) of a given sheet S of recording medium, and designated by a character B is each of the two portions of the outward surface of the belt 45, which is outside the path of a given sheet S of recording medium, in terms of the widthwise direction of the belt 45. The measurement of the portion A of the belt 45 and the measurement of the portion B of the belt 45 are affected by the width of a given sheet S of recording medium being used for image formation.

The water beads c resulting from the condensation of the water vapor from a sheet S of recording medium, upon the outward surface of the portion A of the belt 45 of the first belt unit 21A is used in the nip N21 to moisturize the surface of the sheet S, on which a fixed toner image is present. The water beads c resulting from the condensation of the water vapor from the sheet S of recording medium, upon the outward surface of the portion B of the belt 45 of the first belt unit 21A, is not used in the nip N21, and therefore, remains thereon. Then, these water beads c are squeegeed by the belt squeegeeing blade 48, collect along the squeegeeing edge of the blade 48, flow toward the downstream end of the blade 48 in terms of the movement of the belt 45, and collect in a storage container 49.

The water beads which resulted on the outward surface of the portion A of the belt 45, from the condensation of the water vapor from the sheet S of recording medium, upon the outward surface of the portion A of the belt 45, transfer also onto the portion B (out-of-sheet-path portion) of the belt 55 of the second belt unit 21B, and adhere thereto. These water beads c are removed from the belt 55 by a belt squeegeeing blade 58 and collected into a storage container 59, in the same manner as the water beads c on the belt 45 of the belt unit 21A shown in FIG. 3 are squeegeed and collected. Thus, the structural arrangement for removing and recovering the water beads c on the belt 55 of the second belt unit 21B is not going to be described here. Instead, referential codes 55, 58 and 59, which stand for the belt, belt squeegeeing blade, and storage container of the second belt unit 21B, are placed in the brackets in FIG. 3. In the case where FIG. 3 is used to describe the structural arrangement for removing and collecting the water beads c on the belt 55 of the second belt unit 21B, FIG. 3 is a plan view of the second belt unit 21B as seen from below the second belt unit 21B.

The cooling device 21 in this embodiment was tested by the following experiment. That is, 250 sheets S of paper (Canon CS-814: 81 gsm) which were 6.0% in moisture content were conveyed through the cooling device 21 in this embodiment, with the sheet conveyance speed and fixation roller temperature set at 475 mm/s and 170° C., respectively, and then, the sheets S were stacked.

In the case where the sheets S were not conveyed through the cooling device 21, the sheets S became wavy, and the vertical distance between the peak and valley of a wave was as much as 1.8 mm. In the case where a cooling device (21) which does not have the second flat cooling plate 47 was used, the vertical distance between the peak and valley of a wave was no greater than 1.0 mm, which was 14% less than the case in which no sheet cooling device was used at all. Further, after the conveyance of the sheets S through the cooling device (21), the sheets S were 5.6% in moisture content. When these sheets S were kept unattended for one full day in the normal ambience, for example, at 23° C. in temperature and 50% in humidity, the sheets S increased in moisture content to 6.3%.

In the case where 250 sheets of paper are stacked, it is through the edges of each sheet S that the moisture in the air is likely to be absorbed into the sheet S. Thus, as the stack of 250 sheets S is left unattended, the center portion of each sheet S becomes different in moisture content from the edge portions of the sheet S. Further, the greater a given portion of a sheet S is in the amount of moisture absorption, the greater the amount of expansion. Therefore, with the elapse of a substantial length of time, the difference between the center and edge portions of the sheet S in terms of expansion becomes substantial, and therefore, the wavier, the sheet S becomes. In this experiment in which the sheets S were left unattended for one full day, the vertical distance between the peak and valley of a wave became as much as 2.1 mm.

In comparison, in the case where 250 sheets of recording medium were conveyed through the cooling device 21 in this embodiment, the vertical distance between the peak and valley of a wave was no more than 1.0 mm, and the water content of the sheet S was 5.9%, immediately after the conveyance. After the stack of 250 sheets S was kept unattended one full day, the vertical distance between the peak and valley of a wave increased to 1.3 mm.

As is evident from the results of the experiment described above, using the cooling device 21 in this embodiment, which is structured as described above, in order to minimize the amount by which the moisture in a sheet of recording medium is lost due to evaporation while and after the sheet is conveyed through the fixing device 20, can minimize the amount by which the sheet absorbs moisture in the ambient air during the period from immediately after the conveyance of the sheet S through the fixing device 20 to when the sheet S and ambient air reach their equilibrium in terms of moisture content. Therefore, it can reduce the extent to which a sheet of recording medium becomes wavy while it is left unattended after the fixation.

According to the experiment carried out to test the combination of the cooling device and fixing device in this embodiment, a sheet of recording medium loses its moisture content through evaporation even during the very short period in which the sheet travels from the nip N20 of the fixing device to the nip N21 of the cooling device 21. In this embodiment, therefore, the cooling device 21 is structured so that the portion 45A of the loop which the belt 45 forms diagonally extend between the entrance of the nip N21 of the cooling device 21B and roughly the top of the fixing roller 31; the portion of the belt 45, which is moving through the diagonal portion 45A of the belt loop, is cooled by the cooling means 47.

Therefore, the water vapor from a sheet S of recording medium condenses on the cooled portion of the belt 45, turns into numerous water beads, which are conveyed by the movement of the belt 45 to the nip N21 of the cooling device 21. Then, the water beads are conveyed with the sheet S through the nip N21. Thus, they return to the sheet S. That is, a part of the moisture in a sheet of recording medium, which left, in the form of vapor, from the sheet S, is efficiently returned to the sheet S to be kept in the sheet S. Therefore, the sheet S is less likely to become curly and/or wavy. In other words, this embodiment of the present invention can make an electrophotographic printer as high in print quality in terms of curliness and waviness as a conventional printing press.

[Embodiment 2]

Figure 4:
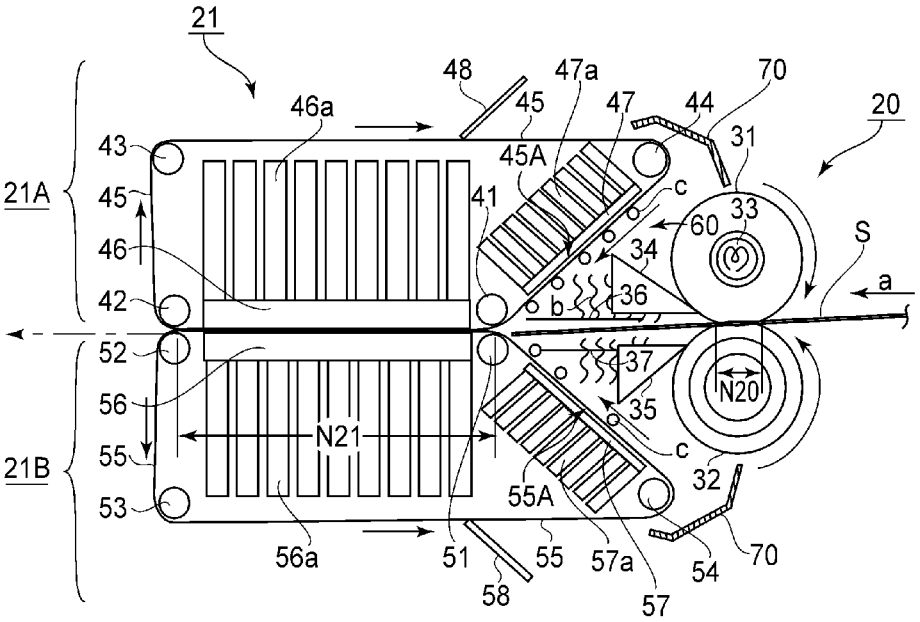
FIG. 4 is a schematic sectional view of the combination of the fixing device and cooling device (cooling apparatus) in the second embodiment of the present invention. It is for describing the general structure of the combination.

Referring to FIG. 4, the cooling device 21 in this embodiment is similar to the cooling device 21 in the first embodiment, except that the cooling device 21 in this embodiment is structured so that the portion of the loop which the belt 55 of the second cooling device 21 has a diagonal portion 55A, through which the belt 55 captures the water vapor from a sheet of recording medium by making the vapor condense thereupon, in the sheet separation space 60.

More specifically, the fourth roller 54, that is, one of the four rollers by which the belt 55 is suspended, is positioned upstream of the first roller 51 in terms of the sheet conveyance direction a, and below the sheet separating bottom member 35. Thus, the belt 55 diagonally extends between the fourth and first rollers 54 and 51. That is, the portion 55A of the loop, which the belt 55 forms between the sheet exit of the nip N20 of the fixing device 20 and the sheet entrance of the nip N21 of the cooling device 21, is angled relative to the sheet conveyance passage, in such a manner that the bottom end of the diagonal portion 55A is below the sheet separating bottom member 35 and sheet conveyance bottom guide 37.

Further, the cooling device 21 in this embodiment is provided with the fourth flat cooling plate 57 (second cooling means), which is placed on the inward side of the portion 55A of the belt loop. The fourth flat cooling plate 57 is provided with heat sinks 57*a*, which are on the opposite surface of the plate 57 from the belt 55. The fourth flat cooling plate 57 is in contact with virtually the entirety of the inward surface of the portion of the belt 55, which corresponds in position to the portion 55A of the belt loop.

The water vapor b, that is, the water vapor which came out of a sheet of recording medium, on the back (bottom) side of the sheet S, in the sheet separation space 60 which is between the sheet exit of the fixation nip N20 and the sheet entrance of the cooling device 21, and through which the sheet S travels before it enters the nip N21 after coming out of the fixation nip N20, flows downward through the multiple ventilation holes of the sheet conveyance bottom guide 37, and adjacencies of the sheet conveyance bottom guiding member 35. Then, it becomes stagnant in the space surrounded by the sheet guiding bottom plate 37, pressure roller 32, and diagonal portion 55A of the belt loop.

Then, it condenses on the outward surface of the portion of the belt 55, which corresponds in position to the portion 55A of the belt loop, and adheres to the outward surface, forming water beads c. Then, the water beads c on the outward surface of the belt 55 are conveyed to the nip N21, and conveyed through the nip N21. While the water beads c are conveyed through the nip N21, they adhere to the back (bottom) surface of a sheet S of recording medium while the sheet S is conveyed through the nip N21, remaining pinched by the two belts 45 and 55.

In other words, in the case of the cooling apparatus 21 in this embodiment, not only is the moisture having evaporated from the top surface of a sheet S of recording medium, that is, the surface on which a toner image is present, efficiently returned to the sheet S, but also, the moisture having evaporated from the back (bottom) surface of the sheet S. Therefore, the cooling apparatus 21 in this embodiment is more effective to prevent the sheet S from becoming curly and/or wavy than the one in the first embodiment.

Incidentally, the amount by which the moisture in a sheet S of recording medium evaporates from the back surface (bottom surface) of the sheet S is smaller than that from the image bearing surface (top surface) of the sheet S. However, unless the water vapor having evaporated from the back (bottom) surface of the sheet S is not returned to the back surface of the sheet, the top and bottom sides of the sheet become different in moisture content, which results in the curling of the sheet S. Employing the cooling device 21 in this embodiment makes it possible to return the moisture having evaporated from the back (bottom) surface of the sheet, to the back surface of the sheet S. Therefore, it can minimize the difference in moisture content between the top (image bearing) surface and back (bottom) surface, and therefore, it can make the sheet S less likely to curl than the cooling device 21 in the first embodiment. Moreover, in the case of the cooling device 21 in this embodiment, not only is the moisture having evaporated from the top surface (image bearing surface) of a sheet S of recording medium returned to the top surface, but also, the moisture evaporated from the bottom surface of the sheet S is returned to the bottom surface. Therefore, the cooling device 21 in this embodiment is smaller in the difference in moisture content of a sheet of recording medium before and after the conveyance of the sheet S through the combination of the fixing device and cooling device. Therefore, it is less in the extent of the waving of the sheet which occurs with the elapse of time than the cooling apparatus in the first embodiment.

[Embodiment 3]

The cooling device 21 in this embodiment is such a modification of the cooling device 21 in the first embodiment that after the water vapor from a sheet S of recording medium condenses on the outward surface of the portion of the belt 45, which corresponds to the portion 45A of the belt loop, it is moved into the portion of the belt 45, which corresponds to the sheet path A. That is, the cooling device 21 in the third embodiment is structured so that the second flat cooling plate 47 (second cooling means), that is, the means for cooling the portion of the belt 45, which corresponds to the diagonal portion 45A of the belt loop, can be changed in its cooling range, in terms of its widthwise direction, according to the width of a sheet of recording medium introduced into the cooling device 21.

In the first embodiment, the cooling device 21 was structured so that while a give portion of the belt 45 is moving through the diagonal portion 45A of the belt loop, where the water vapor from a sheet S of recording medium is made to condense, the second flat cooling plate 47 cools the given portion of the belt 45 across the out-of-sheet-path portion B as well as the sheet path portion A. However, the water beads resulting on the outward surface of the out-of-sheet-path portion B of the belt 45, from the condensation of the water vapor from the sheet S are not returned to the sheet S. The greater the amount by which the moisture from the sheet S is not returned to the sheet S, the less the sheet S is in moisture content after its conveyance through the cooling device 21, being therefore greater in the amount by which it absorbs moisture from the ambience in which it is left unattended. Therefore, the greater the extent to which the sheet S becomes wavy.

Next, the method used in this embodiment to prevent the moisture from a sheet S of recording medium from adhering to the out-of-sheet-path portion B of the belt 45, and make virtually the entirety of the moisture from the sheet S adheres to the sheet path portion A of the belt 45, is described. In this embodiment, the second flat cooling plate 47 is made up of multiple sub-plates aligned in the widthwise direction of the belt 45. Further, in order to enable the cooling device 21 to change its cooling range in terms of the widthwise direction of the diagonal portion 45A of the belt loop, the cooling device 21 is structured so that the multiple sub-plates can be selectively placed in contact with, or separated from, the belt 45, in the diagonal portion 45A of the belt loop.

Figure 5:
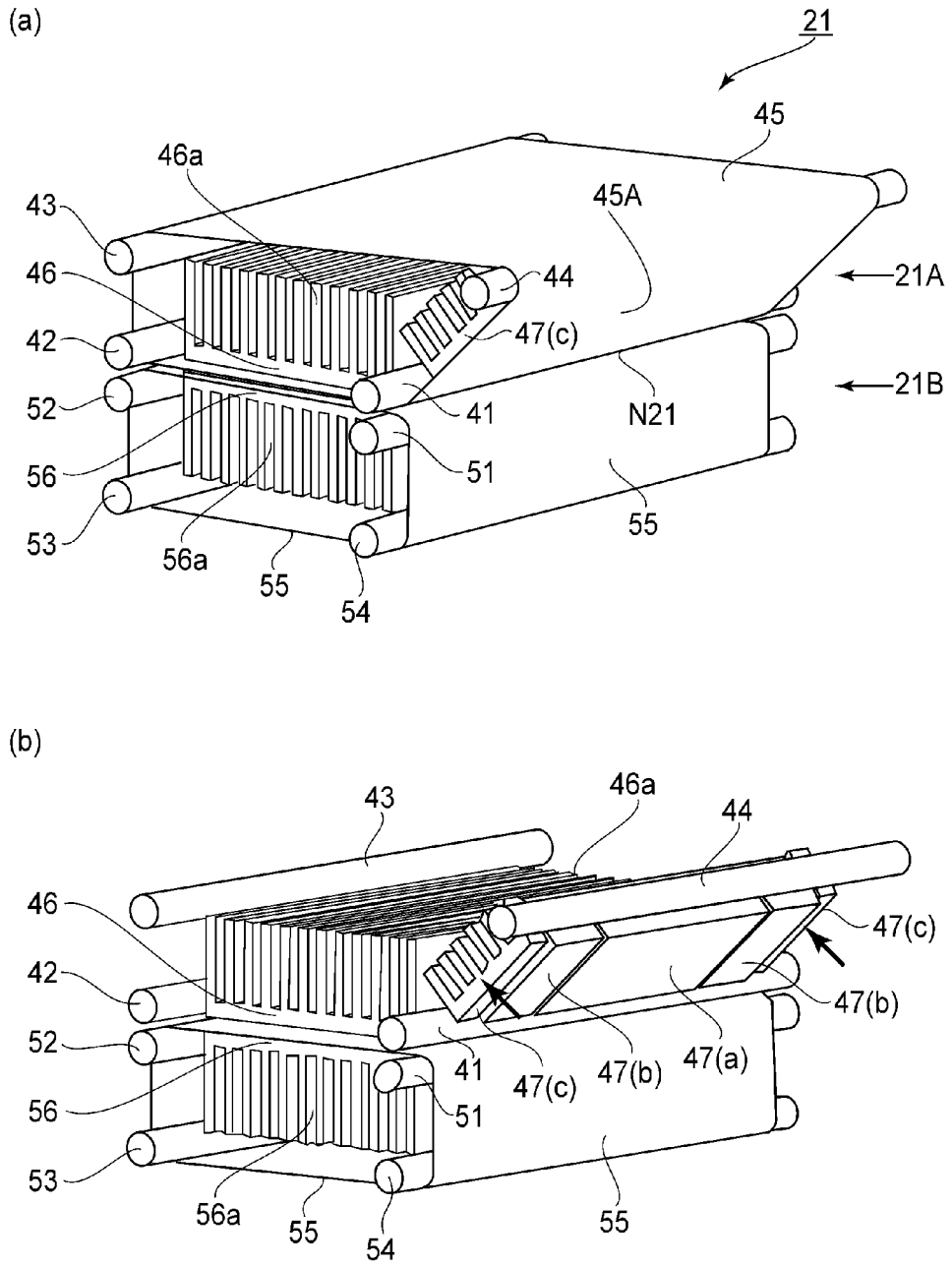
FIG. 5 is a schematic sectional view of the combination of the fixing device and cooling device (cooling apparatus) in the third embodiment of the present invention. It is for describing the general structure of the combination.
Figure 6:
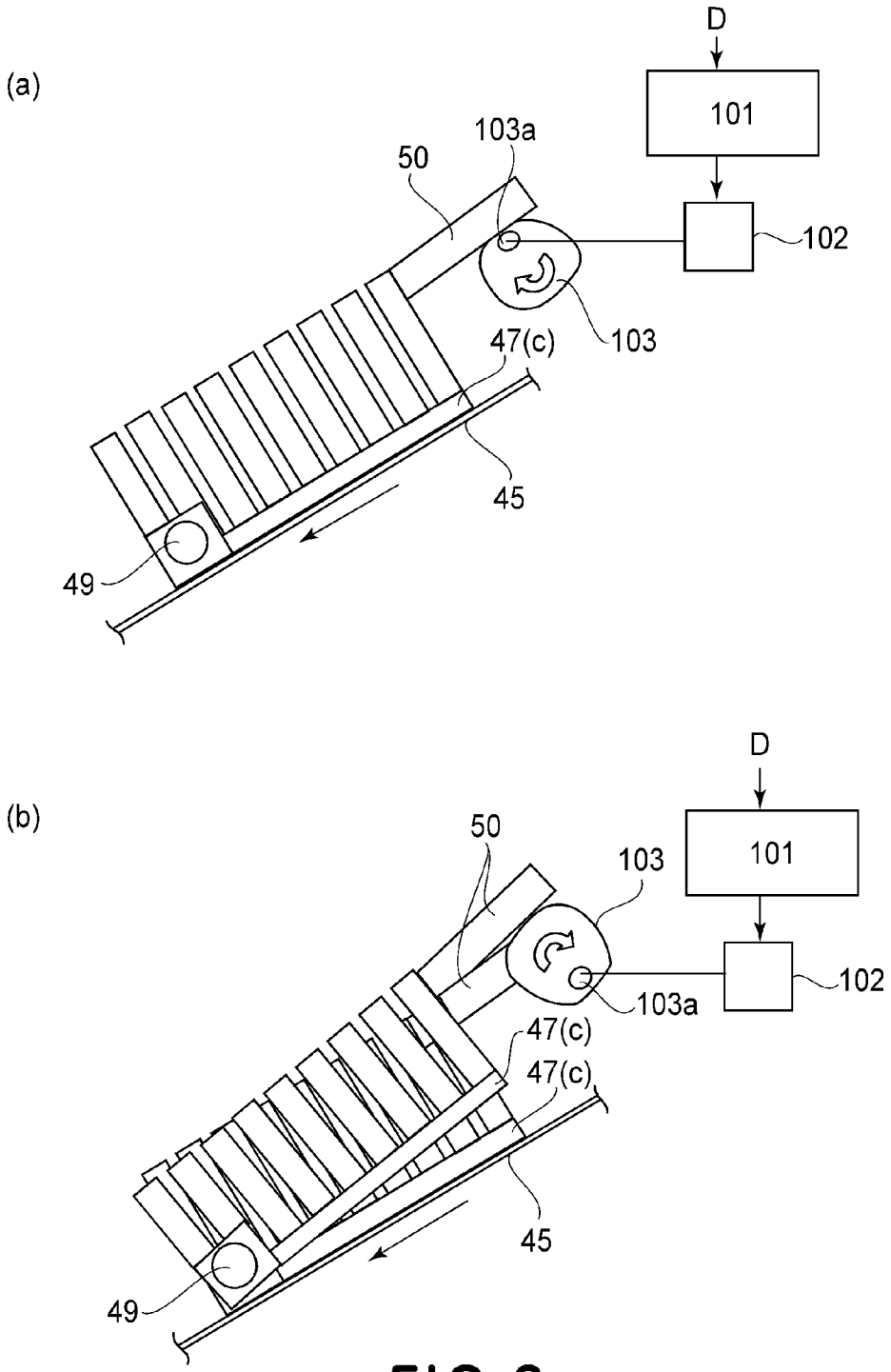
FIG. 6 is a schematic drawing for describing the mechanism for changing in position specific pieces of the multi-piece cooling plate of the cooling device (apparatus) in the third embodiment.

FIG. 5(*a*) is an external perspective view of the cooling apparatus 21 in this embodiment, and FIG. 5(*b*) is an external perspective view of the cooling apparatus 21 in this embodiment, minus the belt 45 of the first belt unit 21A. FIGS. 6(*a*) and 6(*b*) are schematic drawings for describing the system for selectively moving the multiple sub-plates of the second flat cooling 47 (inclusive of heat sinks 47*a*).

In this embodiment, the second flat cooling plate (inclusive of heat sinks 47*a*), that is, the flat cooling plate for cooling the portion of the belt 45, which corresponds to the diagonal portion 45A of the belt loop, is made up of five sub-plates aligned in the widthwise direction of the belt 45. The second flat cooling plate 47 in this embodiment is made up of five sub-plates, more specifically, a center sub-plate 47(*a*), and two pairs of combinations of side sub-plates 47(*b*) and 47(*c*), placed at the ends of center sub-plate 47(*a*), one for one.

The total width of the combination of the abovementioned five sub-plates roughly corresponds to the width of the widest sheet S of recording medium conveyable through the cooling device 21 in this embodiment. The width of the center sub-plate 47(*a*) roughly corresponds to the width of the narrowest sheet S of recording medium which is properly conveyable through the cooling device 21 in this embodiment. The total width of the combination of the center sub-plate 47(*a*) and immediately adjacent two sub-plates 47(*b*) corresponds to the width of a medium width sheet S of recording medium, that is, a sheet S of recording medium, the width of which is between the width of the widest sheet of recording medium and the width of the narrowest sheet of recording medium.

The center sub-plate 47(*a*) is stationarily positioned in contact with the portion of the belt 45, which corresponds in position to the diagonal portion 45A of the belt loop. Referring to FIG. 6, the two pairs of the sub-plates 47(*b*) and 47(*c*), which are at the ends of the center sub-plate 47(*a*), one for one, in terms of the widthwise direction of the belt 45, are pivotally supported by a shaft 49, by one of the lengthwise ends of each sub-plate, being enabled to pivot upward or downward about the shaft 49.

Further, each of the sub-plates 47(*b*) and 47(*c*) is provided with an arm 50, which extends toward the fourth roller 44 from the fourth roller 44 side of the sub-plate. Further, the first belt unit 21A is provided with four eccentric cams 103, which correspond to the arms 50, one for one, and a shaft 103*a*, around which the cams 103 are fitted, and which is rotationally driven by a driving section 102 which is under the control of a control circuit 101. Thus, the cams 103 can be moved into the first position (attitude), in which its short radius portion is in contact with the arm 50 as shown in FIG. 6(*a*), and the second position (attitude), in which its large diameter portion is in contact with the arm 50, as shown in FIG. 6(*b*).

As the cam 103 is rotated into the first attitude, the sub-plates 47(*b*) and 47(*c*) are allowed to downwardly pivot about the shaft 49, and come into contact with the inward surface of the portion of the belt 45, which corresponds to the diagonal portion 45A of the belt loop. That is, when the cam 103 is in the first attitude, the sub-plates 47(*b*) and 47(*c*) remain in contact with the inward surface of the portion of the belt 45, which corresponds to the diagonal portion 45A of the belt loop (FIG. 6(*a*)). On the other hand, as the cam 103 is rotated into the second attitude, the sub-plates 47(*b*) and 47(*c*) are pivoted upward about the shaft 49, being thereby moved away from the inward surface of the portion of the belt 45, which corresponds to the diagonal portion 45A of the belt loop. That is, when the cam 103 is in the second attitude, the sub-plates 47(*b*) and 47(*c*) are kept separated from the inward surface of the portion of the belt 45, which corresponds to the diagonal portion 45A of the belt loop (FIG. 6(*b*)).

The control circuit 101 which functions as a controlling device receives an information D, that is, the size of the sheet S of recording medium which is going to be used for the job, from a host apparatus, or through the control panel (unshown) of the image forming apparatus 100.

In a case when the recording medium size information D received by the control circuit 101 indicates that the recording medium is a sheet of the largest size (widest sheet), all the eccentric cams 101 are moved into the first attitude so that all of the five sub-plates (including center sub-plate 47(*a*)) of the second flat cooling plate 47 come into contact with the inward surface of the portion of the belt 45, which corresponds to the diagonal portion 45A of the belt loop, making it possible for the second flat cooling plate 47 to cool the belt 45 across virtually the entirety of the portion of the belt 45, in terms of the widthwise direction of the belt, which corresponds to the recording medium path A of the widest sheet S of recording medium conveyable through the cooling device 21 (image forming apparatus 100). Thus, the water vapor from the sheet S condenses into water beads, on the outward surface of the portion of the belt 45, which corresponds to the recording medium path A.

On the other hand, in a case where the recording sheet size information D received by the control circuit 101 indicates that the recording sheet is of the narrowest width, all the eccentric cams 103, which correspond in position to all the pivotally movable sub-plates of the second flat cooling plate 47, one for one, are rotated into the second attitude. Thus, only the center sub-plate 47(*a*) remains in contact with the inward surface of the portion of the belt 45, which corresponds to the diagonal portion 45A of the belt loop. Therefore, the portion of the belt 45, which corresponds to the diagonal portion 45A of the belt loop is cooled only across its portion which corresponds to the path of the narrowest sheet of recording medium, and the water beads resulting from the condensation of the water vapor from the sheet adhere to the outward surface of the belt 45 only across the area which corresponds to the path of the narrowest sheet.

Further, in a case where the recording sheet size information D received by the control circuit 101 indicates that the recording sheet is of the medium width, the two eccentric cams 103, which correspond, one for one, in position to the two pivotally movable sub-plates 47(*b*) of the second flat cooling plate 47, that is, the sub-plates which are immediately adjacent to the center sub-plate 47(*a*), are rotated into the first attitude. Thus, the sub-plates 47(*b*) and 47(*b*) come into, and remain in contact, with the inward surface of the portion of the belt 45, which corresponds to the diagonal portion 45A of the belt loop.

Further, the two cams 103, which correspond one for one to the sub-plates 47(*c*) and 47(*c*) of the second flat cooling plate 47, that is, the sub-plates of the second flat cooling plate 47, which are on the outward sides of the sub-plate 47(*b*) and 47(*b*), one for one, are rotated into the second attitude. Thus, the sub-plates 47(*c*) and 47(*c*) are moved, and kept, away from the inward surface of the portion of the belt 45, which corresponds to the diagonal portion 45A of the belt loop (FIGS. 5(*b*) and 6(*b*)).

Thus, the center sub-plate 47*a*, and its adjacent sub-plates 47(*b*) and 47(*b*), are placed in contact with the inward surface of the portion of the belt 45, which corresponds to the diagonal portion 45A of the belt loop. Thus, the belt 45 is cooled across its portion which corresponds to the sheet path A, the width of which roughly corresponds to the width of the medium size sheet. Consequently, the water vapor from the sheet S condenses on the outward surface of the belt 45, across the portion which corresponds to the sheet path A, and adheres thereto, in the form of water beads c.

In this embodiment, the second flat cooling plate 47 is made up of the five sub-plates, more specifically, the center sub-plate which is stationary, and the four sub-plates which are pivotally movable. Further, the cooling device 21 is structured so that the width by which the second flat cooling plate 47 contacts the belt 45 can be changed according to the width of a sheet S of recording medium to be conveyed through the cooling device 21, in order to change the range, in terms of the widthwise direction of the belt 45, across which the belt 45 is cooled in the diagonal portion 45A of the belt loop. The measurement of each sub-plate of the second flat cooling plate 47, in terms of the widthwise direction of the belt 45, is set according to the width of the various sheets S of recording medium different in width, so that the second flat cooling plate 47 contacts the belt 45 across the range which corresponds to the width of the sheet S to be conveyed.

As the range, in terms of the widthwise direction of the belt 45, across which the belt 45 is cooled in the diagonal portion 45A of the belt loop, is set to be no wider than the sheet path A, the water vapor from the sheet S turns into water beads, on the belt 45, across the range which corresponds to the sheet path A, and adhere to the belt 45. Thus, the moisture from the sheet S is returned to the sheet S regardless of the sheet width.

The reason why the cooling range in the diagonal portion 45A of the belt loop is set to be no wider than the sheet path A is as follows: That is, the edge portions of a sheet of recording medium is easier to cool. Further, it is more likely to absorb moisture than the center portion of the sheet, when the sheet is left unattended. Therefore, the edge portions of the sheet do not need to be cooled as much as the center portion of the sheet. Moreover, there are many variations in sheet size. Thus, it is virtually impossible to divide the second flat cooling plate into as many sub-plates as the number of variations in sheet size. This is why the second flat cooling plate (47) in accordance with the present invention is divided into three to five sub-plates to ensure that the cooling range of the second flat cooling plate (47) can be made to be narrower than the width of a sheet of recording medium to be used (less than sheet path width).

With the employment of the above-described structural arrangement, it is possible that the moisture from a sheet of recording medium adheres on the portion of the belt 45, which corresponds to the path of the sheet. Therefore, not only is it possible to prevent the problem that as a print is left unattended for a substantial length of time after its production, it becomes curly and/or wavy, but also, to minimize the amount by which the water vapor from the sheet condenses on the belt 45, across the portions which are outside the sheet path.

The system, in this embodiment, for selectively and pivotally moving the multiple sub-plates of the second flat cooling plate 47, can be applied to the fourth flat cooling plate 57, that is, the cooling plate for cooling the portion of the belt 55 of the second belt unit 21B, which is moving through the diagonal portion 55A of the belt loop (FIG. 4) in the second embodiment.

[Embodiment 4]

Figure 7:
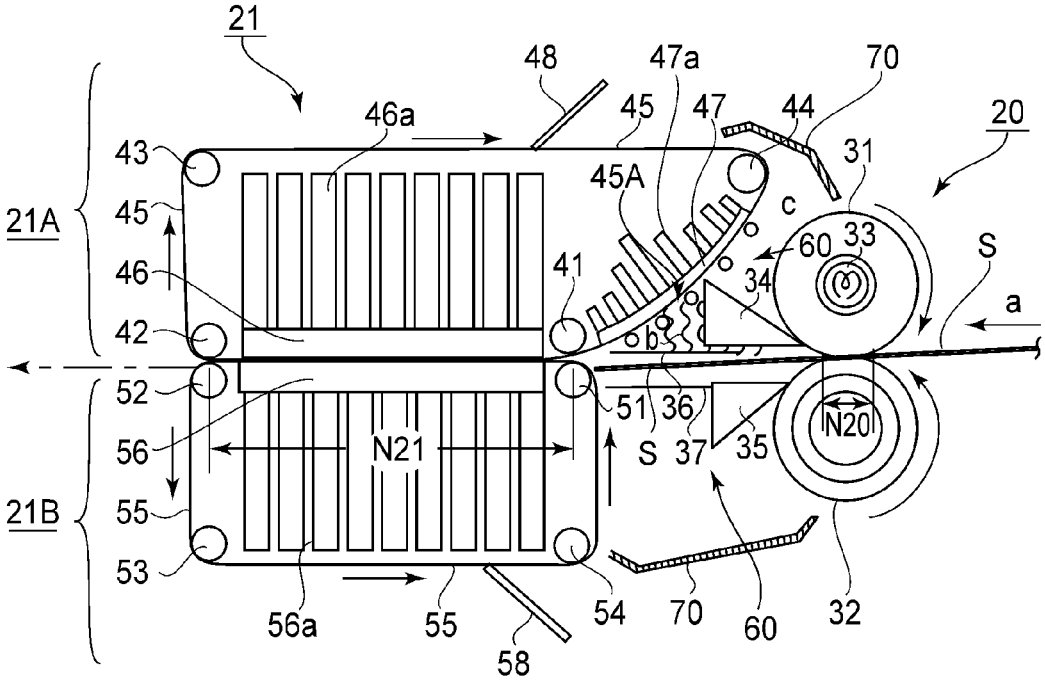
FIG. 7 is a schematic sectional view of the combination of the fixing device and cooling device (cooling apparatus) in the fourth embodiment of the present invention. It is for describing the general structure of the combination.

The cooling device 21 in the fourth embodiment is a modification of the cooling device 21 in the first embodiment. Referring to FIG. 7, the second flat cooling plate 47 in this embodiment is bowed outward of the belt loop, and is in contact with the inward surface of the belt 45. Thus, the portion of the belt 45, which is in contact with the second cooling plate 47, is bowed outward.

This structural arrangement makes it easier for the water vapor from a sheet of recording medium to condense on the portion of the belt 45, which is moving through the outwardly bowed portion 45A of the belt loop, and adheres thereto. This structural arrangement can be applied to the fourth flat cooling plate 57 (FIG. 4), which is for cooling the portion of the belt 45, which is moving through the outwardly bowed portion 55A of the belt loop.

[Embodiment 5]

Figure 8:
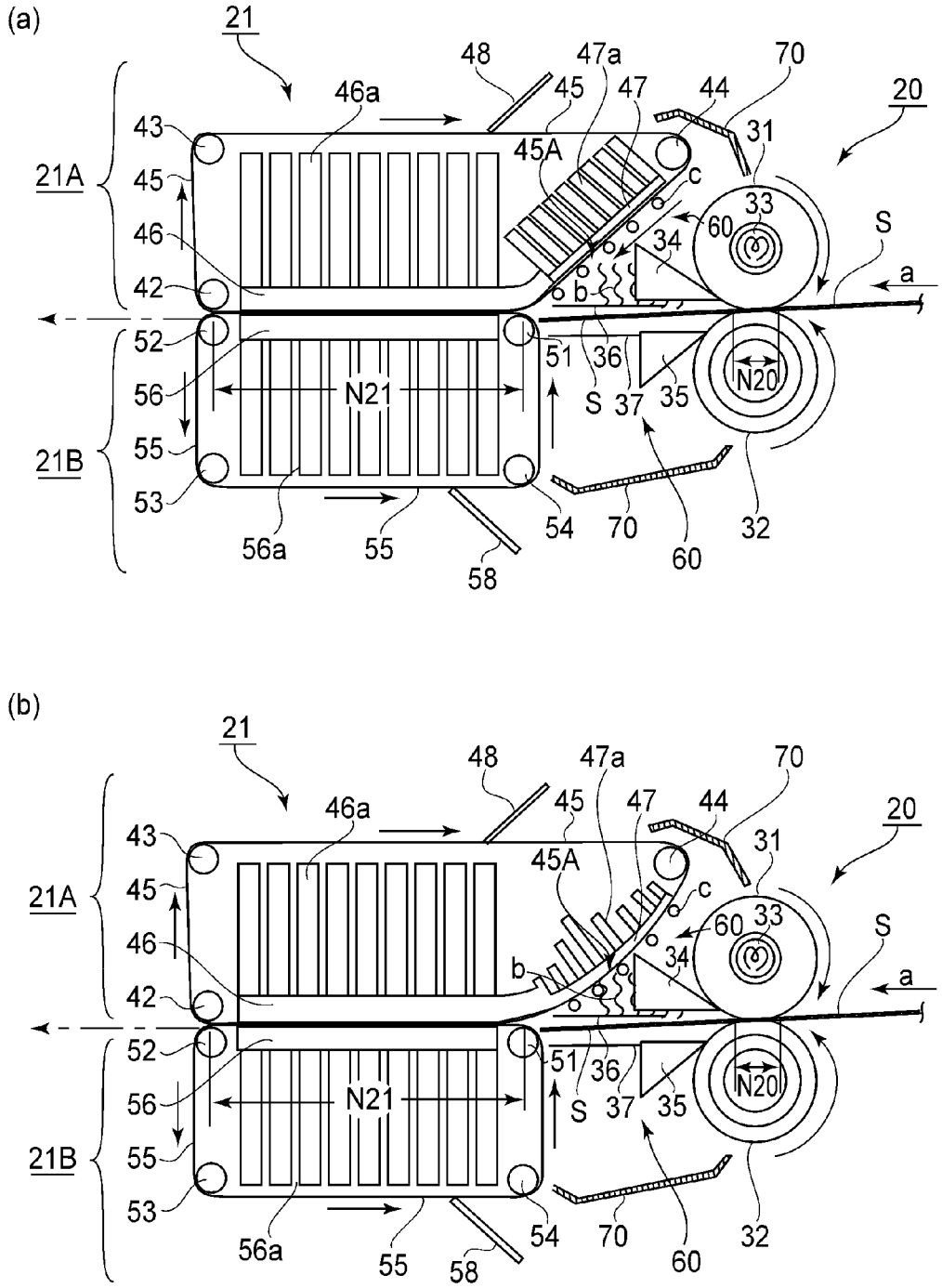
FIG. 8 is a schematic sectional view of the combination of the fixing device and cooling device (cooling apparatus) in the fifth embodiment of the present invention. It is for describing the general structure of the combination.

The fifth embodiment of the present invention is a modification of the first or fourth embodiment. In this embodiment, the first and second flat cooling plates 46 and 47 of the cooling device 21 are connected to each other as shown in FIG. 8(*a*) or 8(*b*). This structural arrangement can be applied to the third and fourth flat cooling plates 56 and 57 of the second belt unit 21B in the second embodiment (FIG. 4).

[Embodiment 6]

The sixth embodiment of the present invention is another modification of the first embodiment. In this embodiment, a sheet backing (holding) plate 21C (FIG. 9(*a*)), on which a sheet of recording medium is to slide, is used in place of the second belt unit 21B in the first embodiment, or multiple rotational rollers 21B are positioned in parallel with preset intervals in terms of the sheet conveyance direction a as shown in FIG. 9(*b*), in place of the second belt unit 21B.

Figure 9:
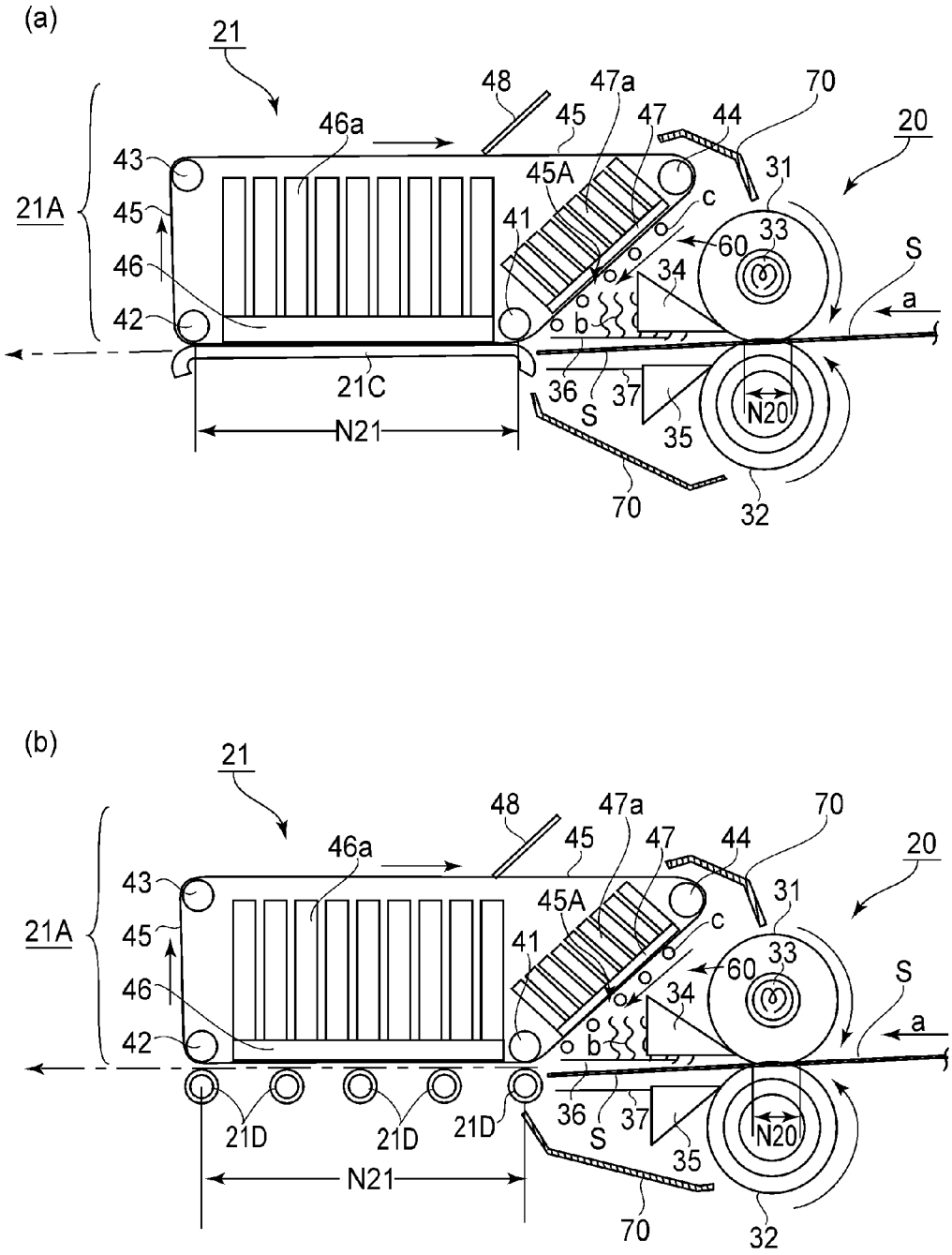
FIG. 9 is a schematic sectional view of the combination of the fixing device and cooling device (cooling apparatus) in the sixth embodiment of the present invention. It is for describing the general structure of the combination.

Referring to FIG. 9(*a*), the sheet backing plate 21C is kept pressed against the first and second rollers 41 and 42, respectively, of the first belt unit 21A, and the first flat cooling plate 46 between the two rollers 41 and 42, with the presence of the belt 45 between itself and the first and second rollers 41 and 42, and also, between itself and the first cooling plate 46, forming thereby a nip N21 between itself and belt 45. The surface of the sheet backing plate 21C, which is facing the belt 45, and on which a sheet of recording medium slides by its back (bottom) surface, is coated with a low friction substance.

Referring to FIG. 9(*b*), the multiple (five) parallel rotational rollers 21D also are kept pressed against the first and second rollers 41 and 42 of the first belt unit 21A, and the first flat cooling plate 46, between the two rollers 41 and 42, of the first belt unit 21A, with the presence of the belt 45 between themselves and the first roller 41, second roller 42, and flat cooling plate 46 of the first belt unit 21A, forming a nip N21 between themselves and the belt 45.

[Miscellaneous Structural Arrangements]

1) The application of the present invention is not limited to a recording medium cooling device structured so that the means to which the heat robbed by the flat cooling plate 46, 47 and 57 from the belt 45 or 55 is transferred to be radiated is a heat sink such as the one in the preceding embodiments. For example, the present invention is also applicable to a recording medium cooling device, the heat radiating means of which is a heat pipe. Further, the present invention is applicable to a recording medium cooling device, the means of which for cooling the belt 45 or 55 is not a flat cooling plate such as the one in the preceding embodiments; it is optional. For example, the present invention is also applicable to a recording medium cooling means, the means of which for cooling the belt 45 or 55 is an air blowing device.

2) The compatibility of the present invention is not limited to a thermal fixing device (as image heating means) of the heat roller type. The present invention is also compatible with a thermal fixing device of any of various known types. For example, it is compatible with a thermal fixing device of the heat chamber type, infrared light type, electromagnetic induction type, or the like.

3) The application of the present invention is not limited to a thermal fixing device as an image heating means. For example, the present invention is also applicable to an apparatus (device) for heating a fixed image on a sheet of recording medium in order to increase the image in glossiness (or like properties).

4) The application of the present invention is not limited to a cooling device for the image formation station(s) of an electrophotographic image forming apparatus. For example, the present invention is also applicable to a cooling device for the image formation station of an electrostatic image forming apparatus, a magnetic image forming apparatus, or the like. Further, the application of the present invention is not limited to a cooling device for an image forming apparatus of the transfer type. For example, the present invention is also applicable to an image forming apparatus structured to directly form an unfixed image on a sheet of recording medium.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 227899/2011 filed Oct. 17, 2011 which is hereby incorporated by reference.

What is claimed is:

1. A sheet processing apparatus comprising:

(i) a fixing device configured to fix an unfixed image formed on a sheet by heat; and (ii) a cooling device configured to cool the sheet heated by said fixing device, said cooling device including:

(ii-i) a rotatable endless belt configured to feed the sheet heated by said fixing device;

(ii-ii) a first supporting member provided above said fixing device and configured to rotatably support an inner surface of said endless belt;

(ii-iii) a second supporting member configured to rotatably support the inner surface of said endless belt at a position where contact of said endless belt and the sheet begins; and (ii-iv) a cooling member configured to cool said endless belt in a region which is downstream of said first supporting member and upstream of said second supporting member with respect to a rotational moving direction of said endless belt to condense, on an outer surface of said endless belt, water vapor produced by a fixing operation.

2. An apparatus according to claim 1, further comprising a cover covering an upper part of a space between said fixing device and said cooling device to suppress outward flowing of the water vapor from the space.

3. An apparatus according to claim 1, wherein said cooling member includes a sliding portion slidable relative to an inner surface of said endless belt, and a heat radiating portion configured to radiate heat from said sliding portion.

4. An apparatus according to claim 3, wherein said sliding portion is slidable on the inner surface of said endless belt in a region which is downstream of said first supporting member and upstream of said second supporting member with respect to a rotational moving direction of said endless belt.

5. An apparatus according to claim 4, wherein said heat radiating portion includes a heat sink.

6. An apparatus according to claim 5, further comprising an air blowing device providing an air flow for cooling said heat sink.

7. An apparatus according to claim 1, further comprising a controller configured to control a cooling range of said cooling member with respect to a widthwise direction of said endless belt, in accordance with a width size of the sheet.

8. An apparatus according to claim 7, wherein said cooling member includes a plurality of sliding portions slidable on the inner surface of said endless belt at positions different with respect to the widthwise direction, and a plurality of heat radiating portions configured to radiate the heat from said sliding portions, wherein said controller retracts at least one of said sliding portions away from said endless belt to reduce the cooling range.

9. An apparatus according to claim 8, wherein said sliding portions are slidable on the inner surface of said endless belt in a region which is downstream of said first supporting member and upstream of said second supporting member with respect to a rotational moving direction of said endless belt.

10. An apparatus according to claim 9, wherein each of said heat radiating portions includes a heat sink.

11. An apparatus according to claim 10, further comprising an air blowing device providing an air flow for cooling said heat sinks.

12. An apparatus according to claim 1, wherein said cooling device includes a removing device configured to remove dew water remaining on said endless belt, and a container configured to store the dew water removed by said removing device.

13. An apparatus according to claim 12, wherein said removing device includes a blade having an edge portion contacting an outer surface of said endless belt, and said blade extends in a direction crossing a widthwise direction of said endless belt.

14. An apparatus according to claim 1, wherein said cooling device includes a feeding member configured to nip and feed the sheet heated by said fixing device between itself and said endless belt.

15. A sheet processing apparatus comprising:

(i) a fixing device configured to fix an unfixed image formed on a sheet by heat; and (ii) a cooling device configured to cool the sheet heated by said fixing device, said cooling device including:

(ii-i) a first endless belt contactable with the sheet heated by said fixing device and traveling above said fixing device; and (ii-ii) a second endless belt cooperative with said first endless belt to nip and feed the sheet heated by said fixing device;

(ii-iii) a first cooling member provided so as to contact an inner surface of said first endless belt and configured to cool said first endless belt; and (ii-iv) a second cooling member provided so as to contact the inner surface of said first endless belt at a position opposing said fixing device through said first endless belt and configured to (a) cool said first endless belt and (b) condense, on an outer surface of said first endless belt, water vapor produced by a fixing operation to supply condensed water vapor to the sheet from said first endless belt; and (ii-v) a third cooling member provided so as to contact an inner surface of said second endless belt at a position opposing said first cooling member through said first and second endless belts and configured to cool said second endless belt.

16. An apparatus according to claim 15, wherein said cooling device includes a first supporting member provided above said fixing device to rotatably support the inner surface of said first endless belt, and a second supporting member rotatably supporting the inner surface of said first endless belt at a position where contact of said first endless belt and the sheet begins, wherein said cooling member cools said first endless belt in a region which is downstream of said first supporting member and upstream of said second supporting member with respect to a rotational moving direction of said first endless belt.

17. An apparatus according to claim 15, further comprising a cover covering an upper part of a space between said fixing device and said cooling device to suppress outward flowing of the water vapor from the space.

18. An apparatus according to claim 15, wherein said first cooling member includes a first sliding portion slidable on the inner surface of said first endless belt, and a first heat radiating portion configured to radiate heat from said first sliding portion, wherein said second cooling member includes a second sliding portion slidable on the inner surface of said first endless belt, and a second heat radiating portion configured to radiate heat from said second sliding portion, and wherein said third cooling member includes a third sliding portion slidable on the inner surface of said second endless belt, and a third heat radiating portion configured to radiate heat from said third sliding portion.

19. An apparatus according to claim 18, wherein said cooling device includes a first supporting member provided above said fixing device to rotatably support the inner surface of said first endless belt, and a second supporting member rotatably supporting the inner surface of said first endless belt at a position where contact of said first endless belt and the sheet begins, wherein said second sliding portion is slidable on the inner surface of said first endless belt in a region which is downstream of said first supporting member and upstream of said second supporting member with respect to a rotational moving direction of said first endless belt.

20. An apparatus according to claim 19, wherein said first heat radiating portion includes a first heat sink, said second heat radiating portion includes a second heat sink, and said third heat radiating portion includes a third heat sink.

21. An apparatus according to claim 20, further comprising an air blowing device providing an air flow for cooling said first, second and third heat sinks.

22. An apparatus according to claim 15, further comprising a controller configured to control a cooling range of said second cooling member with respect to a widthwise direction of said first endless belt, in accordance with a width size of the sheet.

23. An apparatus according to claim 15, wherein said second endless belt travels below said fixing device so as to condense, on said second endless belt, water vapor produced by a fixing operation.

24. An apparatus according to claim 15, wherein said cooling device includes a first removing device configured to remove dew water remaining on said first endless belt, and a first container configured to store the dew water removed by said first removing device, and a second removing device configured to remove dew water remaining on said second endless belt, and a second container configured to store the dew water removed by said second removing device.

25. An apparatus according to claim 24, wherein said first removing device includes a first blade having an edge portion contacting an outer surface of said first endless belt, and said first blade extends in a direction crossing a widthwise direction of said first endless belt, and wherein said second removing device includes a second blade having an edge portion contacting an outer surface of said second endless belt, and said second blade extends in a direction crossing a widthwise direction of said second endless belt.

26. A sheet humidifying device comprising:

an endless belt contactable with a sheet having an image fixed by heat; and a cooling member configured to (a) cool said endless belt and (b) condense water vapor deposited on an outer surface of said endless belt into dew water to supply the dew water to the sheet.

27. A sheet cooling apparatus for cooling a sheet which is heated by a fixing device in a fixing operation, said apparatus comprising:

a rotatable endless belt configured to feed the sheet;

a first supporting member provided above the fixing device and configured to rotatably support an inner surface of said endless belt;

a second supporting member configured to rotatably support the inner surface of said endless belt at a position where contact of said endless belt and the sheet begins; and a cooling member configured to cool said endless belt in a region which is downstream of said first supporting member and upstream of said second supporting member with respect to a rotational moving direction of said endless belt to condense, on said endless belt, water vapor produced by the fixing operation.

28. An apparatus according to claim 27, wherein said cooling member includes a heat sink.

* * * * *